US005622156A

United States Patent [19]

Rose et al.

[11] Patent Number: 5,622,156

[45] Date of Patent: Apr. 22, 1997

[54] VENTILATING ARRANGEMENT FOR THE CRANKCASE OF AN INTERNAL COMBUSTION ENGINE

[75] Inventors: Eckart Rose, Stuttgart; Walter Kerschbaum, Fellbach, both of Germany

[73] Assignee: Mercedes Benz AG, Stuttgart, Germany

[21] Appl. No.: 614,094

[22] Filed: Mar. 12, 1996

[30] Foreign Application Priority Data

Mar. 13, 1995 [DE] Germany ..... 19508967.7

[51] Int. Cl.[6] ..... F01M 13/04

[52] U.S. Cl. ..... 123/573

[58] Field of Search ..... 123/572, 573, 123/574, 41.86

[56] References Cited

U.S. PATENT DOCUMENTS

| | | | |
|---|---|---|---|
| 2,493,617 | 1/1950 | Chubbuck | 123/573 |
| 2,642,052 | 6/1953 | Wagner et al. | 123/573 |
| 4,517,951 | 5/1985 | Otaka et al. | 123/572 |
| 4,958,613 | 9/1990 | Hiraoka et al. | 123/572 |
| 5,542,402 | 8/1996 | Lee et al. | 123/573 |

FOREIGN PATENT DOCUMENTS

| | | |
|---|---|---|
| 2103061 | 8/1971 | Germany . |
| 2108270 | 8/1972 | Germany . |
| 4012415 | 10/1991 | Germany . |
| 6-123212 | 10/1992 | Japan . |

*Primary Examiner*—Marguerite McMahon
*Attorney, Agent, or Firm*—Klaus J. Bach

[57] ABSTRACT

In a ventilating arrangement for an internal combustion engine, a venting line for supplying venting gases from the engine crankcase to the air intake pipe includes an oil separator from which an oil return line extends downwardly on the outside of the engine crankcase front wall into an upwardly open oil pocket also arranged on the outside of the crankcase front wall so as to form a siphon therewith through which the oil can return from the oil separator to the oil sump in the oil pan under the crankcase against the excess pressure normally developing therein during engine operation.

9 Claims, 1 Drawing Sheet

VENTILATING ARRANGEMENT FOR THE CRANKCASE OF AN INTERNAL COMBUSTION ENGINE

BACKGROUND OF THE INVENTION

The invention relates to a ventilating arrangement for the crankcase of an internal combustion engine with which crankcase gases are returned to the intake pipe of the engine by way of a venting pipe including an oil separator with an oil return line which is arranged at the front wall of the engine and through which oil separated in the oil separator is returned to the oil pan at the bottom of the crankcase.

Such a ventilating arrangement is known for example from DE OS 21 08 270 which discloses an internal combustion engine with a crankcase from which gases and oil vapors under excess pressure are removed. Such a ventilating arrangement prevents the development of excess pressure and temperatures in the crankcase which could lead to the formation of explosive oil vapor/gas mixtures. For the discharge of the vent gases from the crankcase a venting pipe is provided. However, because of environmental considerations, the vent gases are not discharged to the environment, but are admixed to the intake air and are burnt in the engine. The vent pipe includes an oil separator in which oil particles carried along with the vent gases are collected. The oil collected in the oil separator is returned to the oil pan at the bottom of the crankcase by way of an oil return pipe. The vent pipe, the oil separator and the oil return pipe are arranged on the side outside the engine block and require a relatively large amount of space. Especially the oil return pipe must be assembled from pipes which have to be prepared and interconnected by connecting pieces which is quite expensive and time consuming. Also, assembly errors and wear over long periods of engine operation may lead to troublesome leaks.

SUMMARY OF THE INVENTION

In a ventilating arrangement for an internal combustion engine a vent line for supplying venting gases from the engine crankcase to the air intake pipe includes an oil separator from which an oil return line extends downwardly on the outside of the engine crankcase front wall into an upwardly open oil pocket also arranged on the outside of the crankcase front wall so as to form a siphon therewith through which the oil can return from the oil separator to the oil sump in the oil pan under the crankcase against the excess pressure normally developing therein during engine operation.

The oil collected in the separator flows down along the front wall to the crankcase. This requires normally no additional space since the oil return line runs directly along the front wall of the crankcase at least over most of its length.

The oil return line may be a passage cast integrally with the crankcase thereby eliminating the need for mounting a separate oil drain line.

In another embodiment, the drain line may be formed by a passage drilled into a raised wall portion cast onto the front wall of the crankcase. With this embodiment, the oil drain passage may have a small diameter.

If a separate drain line is used it is advantageous if the oil drain line is arranged on the front wall outside of the crankcase. The line is then preferably arranged adjacent a front side wall section of the crankcase which generally protrudes slightly beyond the outer surface of the front wall of the crankcase by a distance corresponding to the outer diameter of the oil drain line. In this arrangement, the side wall edges project somewhat beyond the oil drain line so that the length of the crankcase is not affected by the presence of the oil drain line.

Preferably, the free lower end of the oil drain line extends into an upwardly open oil pocket formed above the oil pan on the outside of the front wall of the crankcase. The free end of the oil drain line is immersed into oil collected in the oil pocket so that the excess pressure in the crankcase causes an oil level in the drain line compensating for the crankcase pressure. The oil column in the drain line compensates for the pressure in the crankcase so that the oil flows back into the crankcase in spite of the lower pressure level in the oil separator.

During engine operation, the oil pocket is maintained filled by oil from the engine oil return line and by splash oil which is thrown off gears disposed in a gear chamber adjacent the crankcase. The oil overflowing the oil pocket flows downwardly through the gear chamber into the oil pan.

The oil pocket is preferably formed by a rib projecting from the front wall while a side wall of the oil pocket is formed by the outer surface of the front wall. The other side wall of the oil pocket is suitably formed by a second rib which projects from a cover of the gear chamber.

In a particularly space saving arrangement the oil separator may be arranged on the top side of the motor block preferably about above the front wall of the crankcase. In this arrangement, the oil drain line extends suitably through an opening in the top side of the engine block into the gear space; the oil drain line, in this case, may simply extend downwardly in a straight line.

Advantageous embodiments of the invention will be described in greater detail on the basis of the enclosed drawings:

DESCRIPTION OF A PREFERRED EMBODIMENT

Figure 1:
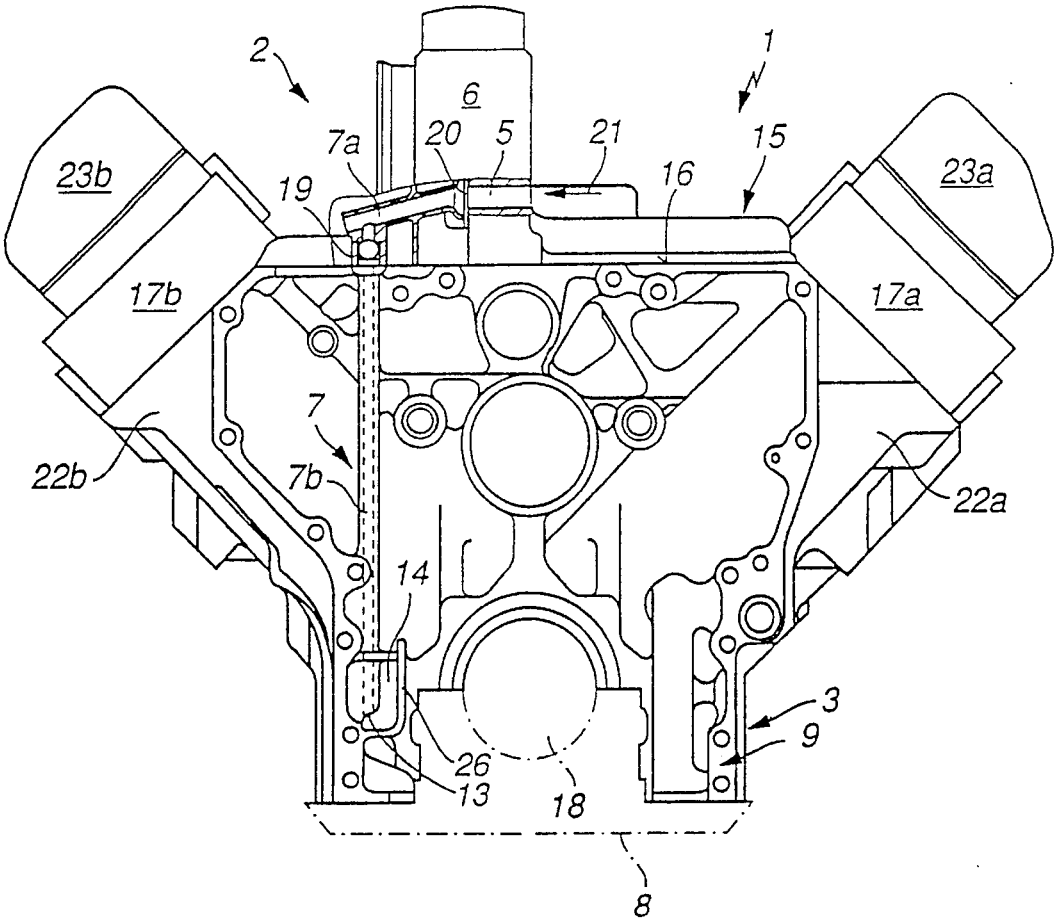
FIG. 1 is a front view of an engine crankcase with the ventilating arrangement according to the invention.

The internal combustion engine 1 shown in FIG. 1 is a turbocharged Diesel engine as it is advantageously utilized in commercial vehicles. The engine has cylinders 22*a*, 22*b* arranged in a V-shape and having cylinder heads 17*a*, 17*b* on which valve covers 23*a*, 23*b* are mounted. The cylinders 22*a*, 22*b* include pistons which drive a crankshaft 18 supported in a crankcase 3. The crankshaft 18 has an end extending beyond the engine block 15 containing the cylinders into a timing gear chamber 4 (FIG. 2) disposed adjacent the crankcase 3. In the timing gear chamber 4, the crankshaft carries drive means for operating cam shaft, injection pump and other accessories such as an oil pump via gears, chains or belts.

At the bottom of the crankcase 3, there is an oil pan 8 which collects the oil required for the lubrication of all the moving components in the crankcase and the timing gear chamber. Gases leaking from the combustion chambers of the cylinders (blow-by-gases) and vapors generated by the engine and the friction heat provide, in the crankcase 3, an oil vapor/air mixture which is under excess pressure and which must be vented out of the crankcase. For this purpose, a ventilating arrangement 2, shown schematically, is provided by which the blow-by-gases are not discharged to the environment but are returned to the engine intake pipe where they are admixed to the intake air and burnt in the engine.

Particularly charge-air cooled Diesel engines generate relatively large amounts of blow-by-gases which contain also relatively large amounts of atomized or vaporized engine oil. In order to limit the oil consumption and also to avoid soiling of the compressor, the charge air ducts and the charge air cooler by oil deposits, the oil is filtered out of the air in an oil separator 6 which is disposed in the ventilating arrangement. The oil separated from the air is returned to the oil pan 8 at the bottom of the crankcase 3 by way of an oil return line 7. The vent gases free of oil then continue to flow through the venting line 5 to the engine air intake pipe.

In order to design a ventilating arrangement 2 with a venting line 5, an oil separator 6 and an oil return line 7 in such a way that the expenses herefor are at a reasonable level and that the arrangement can be accommodated without the need for additional installation space and is also reliable in operation and easy to install, the oil return line 7 is arranged essentially at a front wall 9 of the crankcase 3 where it extends down to the oil pan 8.

The oil return line 7 extends along the front wall 9 of the crankcase 3 preferably vertically so that it is as short as possible. That is, it consists essentially of a straight-line duct extending along the crankcase front wall. No pipes and ducts with connecting pieces that have to be sealed and are expensive to manufacture and to assemble are employed. Also the chances of leakages as a result of assembly errors and wear are reduced. For the return line itself no additional mounting space is needed since the return line is arranged directly at the front wall of the crankcase or is even part of the front wall and does not project beyond other engine components projecting from the outer wall 24 of the crankcase such as the crankshaft 18.

As shown in FIG. 1, the oil separator 6 may be arranged on the top side 16 of the block 15 of the internal combustion engine 1. Suitably, the oil separator 6 is disposed near the front end of the engine. At this location, it will not affect the length nor the width of the motor block. Also, the height of the engine block remains essentially unaffected since the height of the oil separator is essentially the same as that of the cylinders 22*a*, 22*b* including cylinder heads 17*a*, 17*b* and valve covers 23*a*, 23*b* projecting from the top side 16 of the engine block 15. It is also advantageous that the oil separator 6 is located at an essentially higher level than the oil pan 8 so that the potential energy provided by such higher location can be utilized for the return flow of the oil from the oil separator through the oil return line.

The oil separator 6 includes a filter 20 which filters the oil droplets out of the flow of vent gases. In flow direction 21, there is a greater pressure in the oil separator 6 ahead of the filter 20 that is on the side in communication with the crankcase than there is after the filter 20. Because of the flow conditions, the oil is collected on the backside of the filter 20 where there is the lower pressure of the air intake pipe (not shown). The oil dripping from the filter 20 is conducted out of the oil separator 6 by way of a short transverse pipe section 7*a*. The transverse pipe 7*a* leads to the vertical return line section 7*b* of the return line 7 which extends downwardly through a bore 19 in the top side 16 of the engine block 15.

Since the oil collected in the oil separator has to be returned to the oil circuit of the engine against the pressure in the crankcase 3 which is in excess of the atmospheric pressure, the free lower end 13 of the oil return line 7 preferably extends into an oil pocket 14. The oil return line 7 ends below the oil level in the oil pocket 14 so that, at the bottom end of the oil return line 7, a siphon is formed whereby the oil level in the return line 7 can be maintained high enough to provide an oil column of sufficient hydrostatic pressure to compensate for the excess pressure in the crankcase 3.

The oil pocket 14 is arranged slightly above the oil pan 8 in such a way that the splash oil of the crankshaft, the camshaft and of timing gears can reach the oil pocket 14. The oil return line 7 extending into the oil pocket 14 is, in accordance with FIG. 2, suitably arranged at the outside 24 of the front wall 9 opposite the crankcase interior 11. It may be formed as a passage 10 cast onto the front wall 9 of the crankcase 3. In accordance with another advantageous embodiment, the passage 10 may be a bore drilled into a straight projection cast onto the front wall 9 of the crankcase 3.

Figure 2:
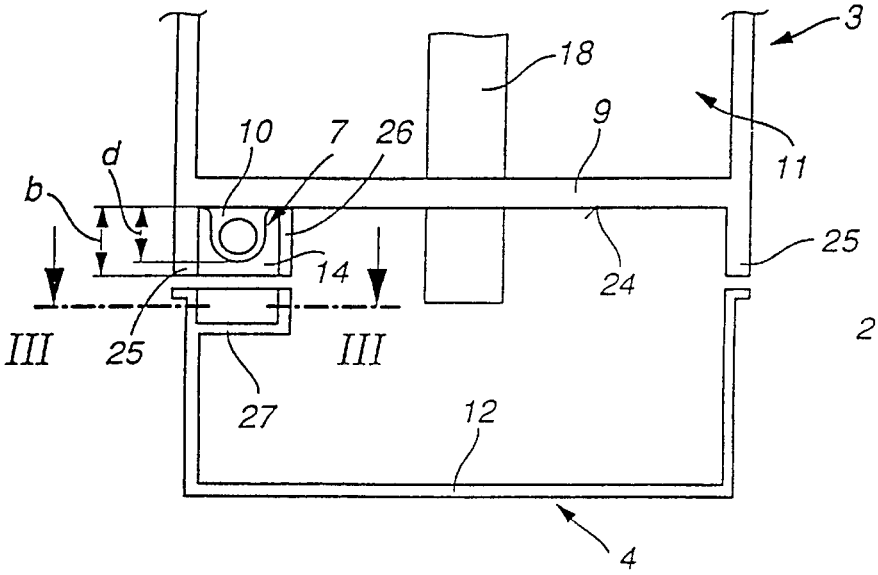
FIG. 2 is a top view of a schematic representation of a crankcase with adjacent gear chamber in which the oil drain line is arranged.

As indicated in FIG. 2, the oil return line 7 is preferably disposed adjacent one of the two front portions of the side wall sections 25 of the crankcase 3, the side wall sections 25 projecting beyond the outside 24 of the front wall 9 at least by an amount corresponding to the outer diameter d of the oil return line. In the arrangement as shown in FIG. 2, the side wall sections 25 project beyond the outside surface 24 of the front wall 9 by an amount b which is greater than the outer diameter d of the oil return line 7. As this will be normally the case, the axial length of the crankcase 3 is not increased by the arrangement of the oil return line 3 on the outside of the crankcase front wall 9.

Figure 3:
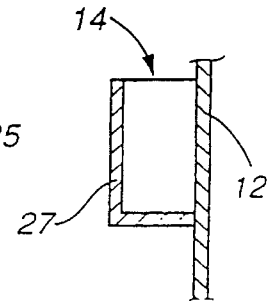
FIG. 3 is a cross-sectional view taken along line III—III of FIG. 2.

The oil pocket 14, which is maintained filled by splash oil from the timing gear chamber 4 and by oil returning from the oil separator, is also arranged on the outside 24 of the front wall 9. An about L-shaped rib 26 is cast onto the outside 24 of the front wall 9 which forms a wall portion of the oil pocket 14 as shown in FIG. 1. The lower leg of the rib 26 extends to the side wall section 25 which forms another wall portion of the oil pocket. A further side wall portion of the oil pocket 14 is formed by the outside surface 24 of the front wall 9. The wall opposite thereto is formed by a second rib 27 which is cast onto the cover 12 of timing gear chamber 4. As shown in FIG. 3, which represents a cross-sectional view along lines III—III of FIG. 2, the second rib 27 is also L-shaped like the first rib 26 and is formed integrally with the cover 12. The second rib is about as high and wide as the first rib 26, however, its depth may be varied dependent on the desired capacity of the oil pocket 14. When the cover 12 of the timing gear housing 3 is mounted onto the crankcase 3, the two ribs 26 and 27 and the side wall section 25 of the crankcase and also the outer surface 24 of the front wall 9 form the upwardly open oil pocket 14 which has approximately the shape of a cubicle.

In accordance with an embodiment not shown in the drawings, it is also possible to provide an oil return line in the form of a bore extending completely through the front wall 9 of the crankcase 3. The oil return line may also be a pre-manufactured line which is mounted along the front wall 9 of the crankcase 3.

The ventilating arrangement according to the invention may also be used in connection with gasoline engines whether they are normally aspirated or provided with a turbocharger.

What is claimed is:

1. A ventilating arrangement for an internal combustion engine having an engine block including a crankcase with a front wall, a timing gear chamber in front of said crankcase and an oil pan on the bottom thereof and also having an air intake pipe for supplying combustion air to said engine, said arrangement comprising a venting line for conducting venting gases from the engine crankcase to the air intake pipe, an oil separator arranged in said venting line, an oil return line for returning oil separated from said venting gases in said oil separator back to said oil pan, said oil return line being disposed on the outside of said engine block and crankcase front wall and extending on said front wall downwardly toward said oil pan, and an upwardly open oil pocket formed on the outside of said crankcase front wall above said oil pan, said oil return line having a bottom opening disposed in said oil pocket so as to provide a siphon therewith.

2. A ventilating arrangement according to claim 1, wherein said oil return line is a passage cast into said front wall.

3. A ventilating arrangement according to claim 1, wherein said oil return line is a bore drilled into a longitudinal projection cast onto said front wall.

4. A ventilating arrangement according to claim 1, wherein said crankcase has forwardly projecting side wall sections and said oil return line extends adjacent one of said side wall sections.

5. A ventilating arrangement according to claim 4, wherein said side wall sections project beyond said front wall at least by an amount which corresponds to the outer diameter of said return line.

6. A ventilating arrangement according to claim 1, wherein said oil pocket is formed by a rib cast onto the front wall of said crankcase.

7. A ventilating arrangement according to claim 6, wherein a timing gear case cover is disposed on the front wall of said crankcase and one side wall of said oil pocket is formed by a rib cast onto said cover when said cover is mounted onto said front wall.

8. A ventilating arrangement according to claim 1, wherein said oil separator is arranged on top of said engine block adjacent the front wall of said crankcase.

9. A ventilating arrangement according to claim 8, wherein said oil return line extends straight downwardly through an opening in the top of said engine block.

* * * * *